United States Patent [19]

Liebel

[11] Patent Number: 4,708,247

[45] Date of Patent: Nov. 24, 1987

[54] SLIP SHEET

[75] Inventor: Henry L. Liebel, Cincinnati, Ohio

[73] Assignee: Signode Paper Products Company, Cincinnati, Ohio

[21] Appl. No.: 857,256

[22] Filed: Apr. 30, 1986

[51] Int. Cl.[4] ..... B65D 21/02

[52] U.S. Cl. ..... 206/501; 206/449; 206/514

[58] Field of Search ..... 206/501, 503, 449, 453, 206/454, 555, 514

[56] References Cited

U.S. PATENT DOCUMENTS 3,354,021 11/1967 Roget ..... 220/455

*Primary Examiner*—George E. Lowrance

*Attorney, Agent, or Firm*—Wood, Herron & Evans

[57] ABSTRACT

A method for forming paperboard slip sheets for receiving, handling, storing and shipping a unitized load of products. The method includes embossing in a surface of the paperboard sheets a pattern of indentations, the pattern being such that when the slip sheets are stacked the indentations are not in registry and do not nest one with another. The depth of the indentations is sufficient such that when a suction is applied to a surface of the top sheet of the stack to grip the top sheet for transfer, only the top sheet is gripped thereby thus preventing the transport of more than one slip sheet at a time.

1 Claim, 6 Drawing Figures

SLIP SHEET

BACKGROUND OF THE INVENTION

This invention relates to slip sheets for receiving, handling, storing and shipping a unitized load of product and, more particularly, to an improved paperboard slip sheet.

In many applications, product, e.g., cartoned or bagged product, is unitized to achieve economies by receiving, shipping, handling and storing the product in bulk loads. For many years, these unitized loads have been carried on conventional hardwood pallets. The wooden pallet system for handling unitized loads was adopted as the most popular system initially because the wood pallet was low in cost, availability of wood was adequate, and it was easy to handle the product on the wooden pallet with a standard and relatively low cost forklift truck. However, the use of wooden pallets has suffered from a number of disadvantages including high initial investment cost, problems in inventorying, storing, and returning the pallets; high handling and transportation costs in shipping pallets in two directions; the fact that wooden pallets consume a high percentage of available hardwood; high cost of pallet maintenance to keep the pallets in service and high cost of pallet replacement; problems of lost pallets; and high weight and volume which adds significant cost to shipment and space requirements for storage of the pallets. Wooden pallets can also cause damage to the load during handling and storage, for example, by nails and broken boards rupturing packages mounted on the pallets and product overhang and load settling into broken areas deforming the load. Further, damage can also result to the top of the load when another wooden pallet is placed on top of it.

Because of these and a number of other disadvantages of wooden pallets, the slip sheet method of handling unitized loads was adopted in the mid-1950's and its use has continued to expand up to today. A slip sheet is a thin sheet of material, typically a solid paperboard fiber, which is of a length and width generally the size of the unit load. The slip sheet has one or more "lips" or "pull tabs" which extend about three or four inches beyond the load allowing the slip sheet to be gripped and pulled onto the platens of a forklift truck with the aid of a gripper or push-pull attachment mounted to the forklift truck. Typically, the slip sheets are provided with lips or pull tabs on adjacent sides allowing the load to be picked up either from the front or the side for convenience of loading and full utilization of trailer width, although they can be made with up to four lips or tabs.

Solid fiber is the most commonly used material for slip sheets. Fiber slip sheets have been constructed by laminating three or more sheets of kraft paper together with a waterproof adhesive. The thickness of the sheets typically varies from 0.025 to 0.090 inch. This is typically accomplished by varying the thickness of the individual kraft sheets which make up the lamination. The use of slip sheets has contributed significant economies over the use of wooden pallets. Their cost is approximately 1/10 that of a hardwood pallet; and, since they are expendable, they do not require any maintenance, inventory or return. They can thrown away at the end of the first trip or, if desired, reused until worn out. Moreover, the loss of slip sheets is not a problem. Because they take up essentially no room, slip sheets allow more space in the trailer for the product being shipped. Moreover, since relatively lightweight paper instead of heavy hardwood is being shipped, the weight reduction achieved by using slip sheets instead of wooden pallets creates about a twenty-fold savings of freight weight. Still further, the same number of slip sheets can be stored in about 20% of the space required for wood pallets.

In the palletizing or unitizing process, a stack of slip sheets is typically provided, the sheets are sequentially picked up and transferred one by one to a loading area, and the load unitized on the slip sheet for shipment. Typically, the top sheet of the stack of slip sheets is removed from the stack and transferred to the loading area by means of a suction gripping apparatus. This is a device which includes a number of gripping heads to which a suction is applied to the interior thereof. The suction causes the heads to grip the upper surface of the top slip sheet. The gripper with attached slip sheet is then transferred to the loading and/or palletizing area where the suction is released in turn releasing the slip sheet. The gripper is then moved back to the stack of slip sheets to grip the sheet now at the top of the stack, and the process is repeated. The load to be palletized is placed on the sheet which has been transferred and that load is secured such as by stretch wrapping. It along with its underlying slip sheet is then transferred to a storage or transport area. Once removed, the next slip sheet is gripped by the transfer apparatus and transferred to the loading and/or palletizing area. This transfer process from the stack of slip sheets to the loading area continues until the stack is exhausted.

A major problem which has been observed with this method of transferring slip sheets is that the suction force on the top sheet often penetrates one or two or more sheets below the top sheet thus causing the pick-up and transfer of more than just the top sheet. This problem occurs in slip sheets having a thickness on the order of 0.050 inch and becomes more critical as the thickness of the sheet decreases down to, for example, 0.025 inch. It has been found that it is not possible to sufficiently accurately control the suction force to apply just enough gripping force to grip the top sheet but not the sheet below it. As a result, there exists a significant problem in handling and transporting paperboard slip sheets using the suction gripping method of transfer.

Prior art attempts to solve this problem have included coating the slip sheets with an expensive wax emulsion or calendaring material or providing an extra heavy coating of expensive glue between paperboard laminations forming the slip sheets in an effort to decrease the permeability of the sheets to air flow therethrough. This treatment has several drawbacks including the increased cost of the slip sheets due to the use of expensive coating materials and the fact that the coating requires time for the paperboard to dry thus decreasing the efficiency of the manufacturing operation.

SUMMARY OF THE INVENTION

In accordance with the present invention, the problem of slip sheet transfer described above is overcome without the use of expensive coating materials by providing the slip sheets with a surface embossed with a pattern of indentations therein. The pattern is such that when the slip sheets are stacked one upon another the indentations in adjacent sheets are out of registry such that the sheets do not nest one with another. The depth of the indentations, which may be on the order of 1/16 of an inch, is sufficient to permit air flow between adjacent sheets. Thus, when the suction grippers are applied to the top sheet, air flows between the top sheet and its underlying sheet thus preventing a suction therebetween which would otherwise cause transport of the underlying sheet along with the top sheet. The pattern of embossment is narrow enough such that the gripper head on the top surface extends across it or beyond it permitting a suction to be formed between the gripper head and the surface of the top sheet.

With this arrangement of embossed indentations, the formation of a suction between the top sheet and underlying sheets by means of the gripper heads is prevented. Thus, when the gripper mechanism engages the top sheet, only the top sheet of the stack is gripped thereby and transported to the palletizing area thus eliminating the problem described above with respect to prior art slip sheets.

In accordance with the present invention, the slip sheets are formed by providing a source of paperboard material either in an extended length which is thereafter cut into individual slip sheets or in discreet, pre-cut sheets. The paperboard material is passed between a platen and one or more embossing rolls, the embossing rolls having on their surface a series of raised ribs in the form of the desired embossing pattern. One or more embossing rolls may be used depending on the size of the slip sheet to provide spaced patterns across the width of the slip sheet. As the slip sheets are passed between the platen and embossing rolls, the paperboard is compressed by the raised ribs thereby forming a series of indentations in the surface thereof. The embossment roll is so dimensioned with respect to the size of the slip sheets such that the embossed pattern on successive slip sheets is out of registry such that when the slip sheets are stacked the indentations will not nest one with another. Rather, the indentations permit air flow between adjacent slip sheets.

DETAILED DESCRIPTION OF THE INVENTION

Figure 1:
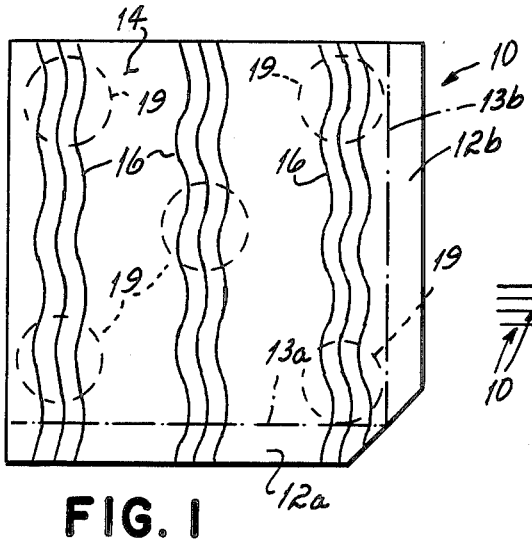
FIG. 1 is a top view of a slip sheet of the present invention showing the embossed pattern in the surface thereof.

Referring now to FIG. 1, in the slip sheet method of handling unitized loads, a load which is unitized, for example, by taping, tying, gluing, cartoning or stretch wrapping, has a defined unit width and length. Typical sizes are roughly 48"×40". A slip sheet 10 is generally a two-dimensional sheet upon which the load rests. The slip sheet typically has one or two lips or pull tabs 12*a* and 12*b* defined by score lines 13*a* and 13*b* which allow the load to be picked up from more than one side. Although slip sheets can be made with up to four lips, they are typically provided with lips on two adjacent sides making it possible to pick up the load from either the lengthwise or widthwise direction of the load, i.e., from the front or side. This insures good utilization of trailer width.

The slip sheet includes a top surface 14. This surface has distributed across its width a pattern of embossed indentations 16 extending from edge to edge of the slip sheet 10. The indentations 16 are such that when the slip sheets are stacked the indentations of one sheet do not register with the indentations of the adjacent sheet thus preventing nesting of adjacent sheets.

Figure 2:
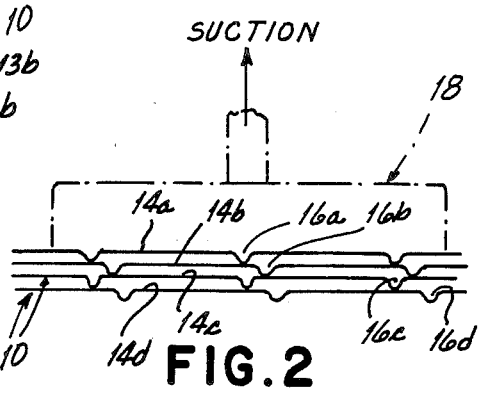
FIG. 2 is a diagrammatic illustration of a cross-section of a stack of slip sheets with the top sheet having a gripper head thereon.

Referring to FIG. 2, there is shown a diagrammatic illustration of a stack of slip sheets. Each sheet includes a top surface 14*a, b, c* and *d*, respectively, having the pattern of indentations 16*a, b, c* and *d*, respectively, therein. The indentations may be of a suitable depth, however, a 1/16" depth has been found to perform satisfactorily. The width of the pattern is such that when a gripper heads 18 are applied to the sheet they extend beyond the embossment pattern (representative gripping area 19 of gripper heads 18 shown in dotted lines in FIG. 1) such that the indentations do not prevent the gripping of the top sheet itself. A suction is applied to the interior of the gripper head 18. The indentations 16 permit air to flow along the embossed indentations from the sheet edges and between the sheets 10. This flow of air between slip sheets 10 prevents a suction from forming between the top sheet and the underlying sheets.

Figure 3:
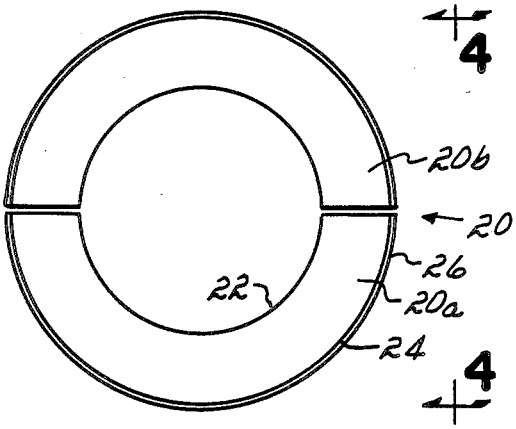
FIG. 3 is a side view of an embossing roll.
Figure 4:
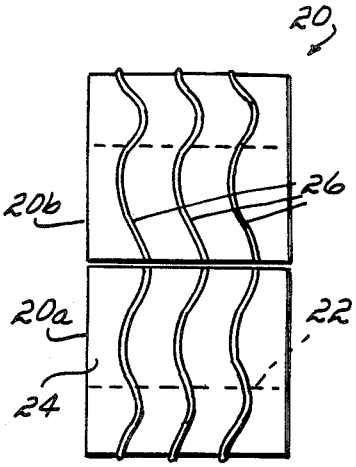
FIG. 4 is a view taken along line 4—4 of FIG. 3 showing the pattern of raised ribs on the embossing roll.

Referring now to FIG. 3, a suitable embossing roll 20 may comprise two halves 20*a*, 20*b* permitting its mounting on to a shaft by means of counterbored machine screws. This permits the rolls to be added or deleted from the shaft and their position along the shaft to be adjusted to provide a desired pattern on the surface of the sheet depending on sheet size. A suitable embossing roll may be 5½" in inside diameter 22 and 8½" outside diameter 24. The outside surface 24 of the roll is engraved to provide raised ribs 26 in a desired pattern. A suitable width of ribs is 1/32 and a suitable height is 1/16 inch. The ribs 26 shown in FIG. 4 providing the embossment pattern shown in FIG. 1 are of a sinusoidal configuration. A suitable separation between ribs is 1 inch. Thus, when the embossing rolls are mounted on the shaft and the paperboard slip sheets pass between the rolls and an underlying platen, the paperboard fibers are compressed by the raised ribs 16 forming the desired pattern of indentations in the surface of the paperboard slip sheet and to a desired depth.

Figure 5:
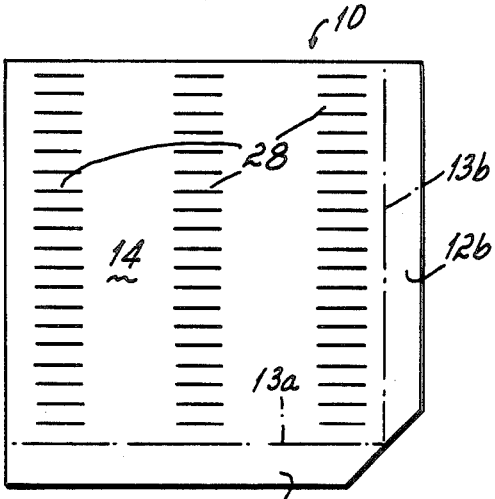
FIGS. 5 and 6 are top views of slip sheets showing alternative embossing patterns.
Figure 6:
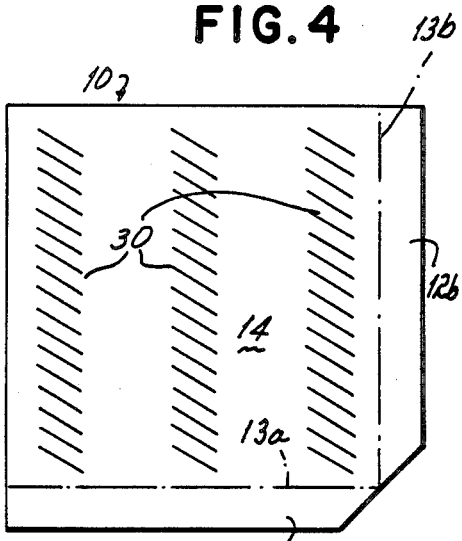

Any of a number of patterns of indentations can be employed. All that is required is that the pattern variation between sheets be such that the indentations do not nest on adjacent sheets thereby defeating the purpose of the present invention. As shown in FIG. 5, the indentations can be in the form of a series of spaced parallel lines 28 or as shown in FIG. 6 in a pattern of diagonal lines 30.

Thus having described the invention, what is claimed is:

1. A stack of paperboard slip sheets, each said sheet having a thickness up to about 0.050 inch and being permeable to the flow of air therethrough caused by suction handling equipment used to pick up individual slip sheets from said stack, each said sheet including in a surface thereof a pattern of identations and in an opposite surface thereof a pattern of protuberances, the identations and protuberances in adjacent slip sheets in said stack being out of registry one with another and the depth of said indentations being such that when a suction is applied to a surface of the top sheet of the stack only the top sheets is gripped and picked up thereby.

* * * * *